United States Patent [19]

Delcroix

[11] 4,229,918

[45] Oct. 28, 1980

[54] COMPLEMENTARY ELEMENTS ASSEMBLEABLE INTO A PARTITION FOR PREEXISTING WALL-PARTITIONS

[76] Inventor: Andre Delcroix, rue Paul Pastur 5, 59391 Wattrelos, France

[21] Appl. No.: 917,580

[22] Filed: Jun. 21, 1978

[30] Foreign Application Priority Data

Jun. 22, 1977 [FR] France ..... 77 19698

[51] Int. Cl.[2] ..... E04H 1/00; E04B 2/74

[52] U.S. Cl. ..... 52/242; 52/290; 52/398

[58] Field of Search ..... 52/242, 241, 290, 399, 52/398, 309.1

[56] References Cited

U.S. PATENT DOCUMENTS

| | | | |
|---|---|---|---|
| 3,685,227 | 8/1972 | Grisard et al. | 52/242 |
| 3,803,787 | 4/1974 | Daggy | 52/241 |

FOREIGN PATENT DOCUMENTS

| | | | |
|---|---|---|---|
| 2120445 | 5/1972 | Fed. Rep. of Germany | 52/241 |
| 1221507 | 1/1960 | France | 52/242 |

*Primary Examiner*—Alfred C. Perham

*Attorney, Agent, or Firm*—Robert E. Burns; Emmanuel J. Lobato; Bruce L. Adams

[57] ABSTRACT

Means for jointing a panel partition to an adjoining surface comprises a sole piece in combination with a joint cover member. The sole piece comprises a plastics strip applied to the edge of the partition and has two feet of dovetail form on its outer face which seat against the adjoining surface. On its opposite face the sole piece has seating surfaces and upstanding flanges for engaging the edges and faces of panels and other internal components of the partition. The cover member is an L-shaped metal section which fits externally with the ends of its limbs abutting an exterior panel face and the adjoining surface respectively and it is held in place by an internal rib engaging in a side slot of the sole piece. A supplementary flange locates it against the panel. The arrangement can provide an efficient sealed joint with the adjoining surface even if there are variations in the fitting clearances. Other additional internal elements can also be incorporated.

13 Claims, 5 Drawing Figures

COMPLEMENTARY ELEMENTS ASSEMBLEABLE INTO A PARTITION FOR PREEXISTING WALL-PARTITIONS

FIELD OF INVENTION

The present invention relates to a device consisting of complementary elements serving as means for jointing or fitting a partition, either sandwich filled or with a central core and either having a carrier framework or being of a self supporting type, to existing floor, ceiling, and side wall interior surfaces adjoining certain outer edges of the partition, the partition being formed by flat elements which may be opaque, translucent or transparent.

BACKGROUND OF INVENTION

In known arrangements, discontinuous jointing elements are used, distributed at intervals along the length of gaps left between the marginal edges of the partition and sole pieces fixed to the existing interior surfaces, the joint being subsequently concealed by cover members.

In this method of jointing, empty spaces remain between the elements and only the cover members, which are generally made of metal, provide any acoustic and/or heat insulating barrier.

Moreover, in consequence of irregularities due mainly to varying fitting clearances, joint cover members of the type used at the present time, forming rails or skirting, rarely provide a perfect fit of their edge against the face of the partition in spite of efforts to achieve a perfect perpendicular relationship between the exterior face of the cover member and its internal fixing rib; on the contrary, there is generally a gap formed locally separating the aforesaid edge of the cover member from this face so that there is no longer an acoustic or heat insulating barrier.

The present invention seeks to overcome this disadvantage by providing a device consisting of complementary elements characterised in that a first essential element is a sole piece section made of plastics material having a cross-sectional configuration which, throughout the whole of its length, presents, on its face at the side which is applied against the existing interior surfaces and which forms the start of the partition, two feet of dovetail form, and presents on the opposite face flat parts on which panels of the partition, and in some cases a central core, can rest edgewise and also some perpendicular flanges against and between which the panels or other elements can rest or be inserted, and having in its two side edges a slot which may be ribbed, and in that a second essential element, complementary to the said first essential element, is a joint cover member (rail, upper or lower skirting, profiled metal section preferably of aluminium) of which the cross-section over the whole of its length has the form of an upright L of which the free end of the shorter side is designed to engage against the panel of the partition and the free end of the other side is designed to engage against the existing interior surface, the longer side of the L also being provided inwardly towards its free end with a rib which is designed to fit into the slot of the sole piece section and which has a length considerably greater than that of the shorter side of the L, and being provided, adjacent but above said rib, with a supplementary flange of which the extremity rests against the panel of the partition and limits the extent to which said rib can enter into the slot of the sole piece section. The aforesaid rib is preferably not precisely parallel to but is slanted slightly towards the shorter side of the L in such a way as to force the free end of this shorter side against the panel of the partition.

BRIEF DESCRIPTION OF DRAWINGS

Other complementary elements will be necessary in certain cases as mentioned in the following description which is given, by way of example only, of various embodiments of the invention illustrated in the accompanying drawing.

In said drawing.

DESCRIPTION OF PREFERRED EMBODIMENTS

Figure 3:
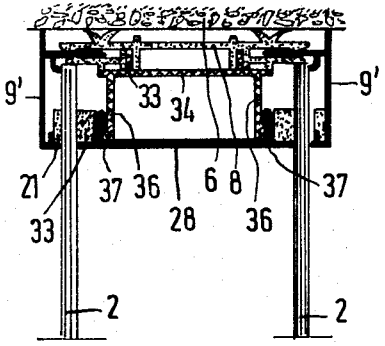
FIG. 3 is a vertical cross-sectional view, limited to the top ceiling edge portion, of a glazed partition.

Referring to the various figures of the drawings, these show the various component parts which may make up a partition. Reference numeral 1 represents an opaque panel, 2 represents a glass panel, 3 represents a central core or filler, and 4 represents an interior framework of a panel sandwich structure. In fitting the partitions, either to a side wall 5, a ceiling 6, or to a floor 7, in each case use is made of a sole piece section 8, representing a first essential element of the means for fitting the partition, made of plastics material and also a joint cover strip, 9 or 9', preferably made of aluminium, which represents a second essential element of the means for jointing or fitting the partition and which is complementary to the said first essential element (sole piece section 8).

This sole piece section 8 comprises feet 10 having a kind of dovetail or forked configuration to provide for a certain amount of compression so as to take up inequalities in the alignment of the interior surfaces to which the panels are to be fitted or even of the panels 1 or 2 of the partitions. Each sole piece 8 also includes two side slots 11 which are preferably grooved, parts 12 and 13 on which the edges of the panels 1 and 2 and of the central core 3 can rest, a flange 15 against which a face of the opaque panels 1 can rest, and pairs of flanges 16 and 17 forming slots 18 for a purpose which will hereinafter be explained.

The cover strip 9 only differs from the cover strip 9' in that it is larger in size. It is possible to use either the cover strip 9 or the cover strip 9' but where the cover strip acts as a bottom skirting, for the sake of appearance and also rigidity, it is preferable to provide a cover strip 9 which is of sufficient size for the lower edge against the floor 7. In contrast, the opposite applies for the upper edge portions against the ceiling 6 or side walls 5 where a narrower skirting is usually desirable and use of the smaller and lighter cover strip 9' is then preferred.

Each cover strip 9 or 9' has a cross-sectional configuration in the form of an upright L of which the outer extremity of the longer side 19 abuts against the floor 7, ceiling 6 or side wall 5, while the outer extremity of the shorter side 20 rests, as shown, against either an opaque panel 1 or a glazed panel 2. In the latter case, as is normal practice, provision is also made for an exterior sealing joint 21 (see FIGS. 3 and 4). Each cover strip 9 or 9' also includes an inwardly directed rib 22 which has a length considerably greater than that of the shorter side 20 and which is designed to be fitted into the respective adjacent slot 11, and also a flange 23 of which the outer edge similarly rests against either an opaque panel 1 or glazed panel 2.

The rib 22 is necessarily positioned near to the outer free end of the side 19 as shown, and the flange 23 is positioned adjacent and extending above the rib 22, again as shown. This flange 23 can branch off from the rib 22. Preferably, the rib 22 is not precisely parallel to the shorter side 20 but slants slightly towards it, but this inclination is not shown in the drawing.

Figure 2:
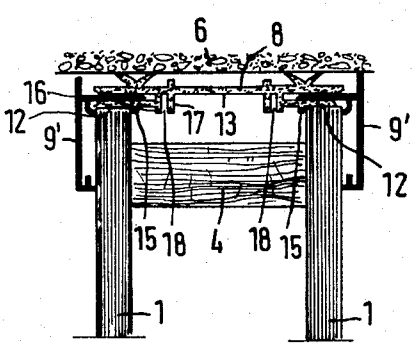
FIG. 2 is a vertical cross-sectional view, limited to the top ceiling edge portion, of a full partition having a panel sandwich structure.
Figure 1:
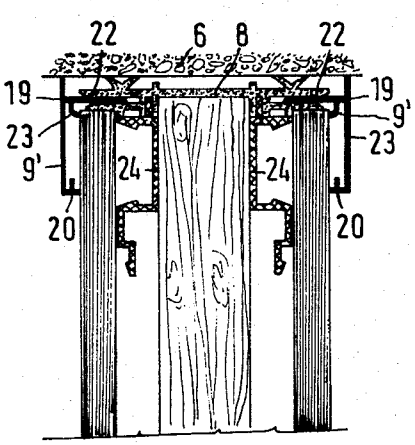
FIG. 1 is a vertical cross-sectional view, limited to the bottom floor edge portion and to the top ceiling edge portion, of a full partition with a central core.

Although, as shown in FIG. 2, it is possible to use only a sole piece 8 and a cover strip 9' (or 9) in the case of a sandwich type partition comprising two opaque panels 1 having an interior framework 4, in the case of a partition having a central core or filler 3 as shown in FIG. 1 it is advisable to provide the central core with an effective support. For this purpose, the use of supplementary elements 24 shaped or profiled (moulded) in plastics material is envisaged, each of these comprising two flat supporting faces 25 and 26, for the central core 3 and for the opaque panels 1 respectively, and each terminating at one side in a flange 27 which is located in a parallel plane set back from the face 25, this flange 27 being adapted to engage in one of the slots 18 of the sole piece section 8. Such supplementary elements 24 are also used in the arrangement shown in FIG. 5 as a support for the two opaque panels 1 of a partition which is held elsewhere by other means (not shown) of a conventional type on, for example, metal frame sections.

Figure 4:
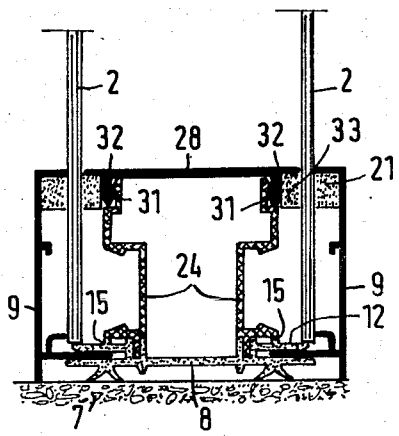
FIG. 4 is a vertical cross-sectional view showing the bottom floor edge portion of a glazed partition.

FIG. 4 also shows another use for these supplementary elements 24 utilised in an edge joint assembly for a partition with spaced glazed panels 2 where there is a need for concealing the joint by means of an aluminium section 28, and consequently a need for means to hold the section 28. For this purpose, use is made of these supplementary elements 24 which are designed so as to terminate at the side opposite to the flange 27 in another flange 29 which is located in a parallel plane set back from the face 26, this flange 29 including a lug 30 which engages, in a usual manner, with a complementary lug 31 carried by each of two flanges or ribs 32 provided on the section 28. Fig. 4 also shows interior joints or seals 33 which are usual for mounting glazed panels 2.

In FIG. 3, which relates to the fitting of a glazed panel 2 to the ceiling whereas FIG. 4 relates to the fitting to the floor 7, there is seen the use of another supplementary element, namely, a profiled section 34 made of plastics material which replaces the two supplementary elements 24. The said profiled section 34 comprises two upright flanges 35 on one side which engage in the slots 18 of the sole piece section 8, and two flanges 36 having lugs 37 on the other side which engage with the lugs 31 of the two flanges 32 of the aluminium section 28.

Figure 5:
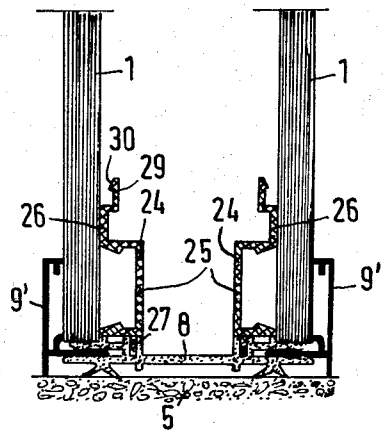
FIG. 5 is a horizontal cross-sectional view showing a side edge portion of a full partition.

Although the arrangement illustrated in FIG. 5 relates to the fitting of the edge of a partition having two opaque panels 1, it will be recognised that it is also possible to use the same arrangement for a solid partition having a single panel, in which case the edge portion of the panel which abuts against the sole piece section 8 is cut away to accommodate the supplementary elements 24. As already indicated, it is possible to provide either the relatively wide cover strips 9 or the narrower cover strips 9'.

The invention is not restricted to the particular forms of construction described and illustrated herein, and various modifications can be made within the scope of the invention as defined in the appended claims.

Incidentally, the cover strip sections 9 or 9' and also the supplementary elements 24, 34 and the aluminium sections 28, can also be used in places other than for the joints at the outermost extremities; and, in regard to the sole piece section 8, this can of course be fixed in position, if desired, such as to a ceiling when a partition is constructed over a doorway.

I claim:

1. A device consisting of complementary elements for the purpose of fitting a sandwich filled or central cored type partition, having either a carrier framework or being a self supporting type and being formed by opaque, translucent or transparent flat elements, to existing interior surfaces, that is, floor, ceiling, and side walls, adjoining certain outer edges of the partition, said device comprising, as a first essential element, a sole piece section made of plastics material of which the cross-sectional configuration throughout the whole of its length presents, on its face at the side which is applied against the existing interior surfaces and which forms the start of the partition, two feet of dovetail form, and presents, on the other face, firstly, flat parts on which the panels of the partition rest edgewise, and secondly, perpendicular flanges against which said panels can rest, and having in its two side edges a longitudinal slot; and further comprising, as a second essential element complementary to the first, a profiled joint cover member of which the cross-section over the whole of its length has the configuration of an upright L of which the outermost end of a shorter side bears against the panel of the partition and the outermost end of a longer side bears against the existing interior surface, the longer side of the L being provided inwardly near its outermost end with a rib which is designed to fit into said slot of said sole piece section and which has a length considerably greater than that of the shorter side of said L, and being provided, above but adjacent to said rib, with a supplementary flange of which the extremity bears against the panel of the partition thereby limiting the extent to which said rib can enter into said slot in the sole piece section.

2. A device in accordance with claim 1, characterised in that there are two pairs of perpendicular flanges on the face of said sole piece section which is opposite to the face which is presented against the existing interior surface, said flanges forming two slots which which receive flanges of at least one supplementary element.

3. A device in accordance with claim 2, characterised in that there are two of said supplementary elements each of which is provided with a flange for insertion into one of the two flange slots of the sole piece section, said element in cross section comprising two opposite flat support faces respectively engaging a central core and opaque panel of the partition, said flange terminating at one side of said supplementary element in a plane parallel to but set back from one of the said support faces.

4. A device in accordance with claim 3, characterised in that said supplementary element terminates at the other side in another flange located in a plane parallel to but set back from the other support face, said other flange including a lug adapted for fixing of a section for concealing at the outermost edges adjoining an existing interior surface the joint assembly of a partition having transparent or translucent panels.

5. A device in accordance with claim 2, characterised in that supplementary element, provided with two flanges for insertion into said two flange slots of the sole piece section, is a profiled section comprising, at the side opposite to the two aforesaid flanges, two further perpendicular flanges each providing a lug adapted for fixing a section concealing, at the outermost edges adjoining an existing interior surface, the arrangement for jointing a partition having transparent panels.

6. A device in accordance with claim 1, characterised in that said rib of said cover member is slightly inclined towards the shorter side of said upright L so as to force the outermost end of said shorter side against the panel of the partition.

7. A device in accordance with claim 1, characterised in that said cover comprises a contoured metal section.

8. Means for jointing the edges of a panel partition to adjoining enclosing surfaces such as existing floor, ceiling and side wall surfaces, said means comprising a sole piece section in the form of a plastics strip which is applied to each respective edge of the partition in combination with at least one joint cover member in the form of an L-shaped metal section which fits externally over the joint between said edge of the partition and the adjoining enclosing surface, wherein the sole piece section has opposite outer and inner faces which are respectively presented outwardly towards the adjoining enclosing surface and inwardly towards the edge of the partition, said outer face being provided with a pair of longitudinal ribs forming projecting feet which have a forked dovetail configuration in cross-section and said inner face being provided with flat seating portions on which exterior panels and, in some cases, a central core component of the partition can rest and with longitudinal upstanding flanges against or between which the edges of said panels and other components of the partition can fit, said sole piece section also being formed at opposite sides with a longitudinal slot which extends laterally into the section and opens outwardly along the respective side edge of the section, and wherein said joint cover member is designed to fit over the joint with the outermost end of its shorter limb abutting against the side face of a said exterior panel of the partition and with the outermost end of its longer limb abutting against the adjoining enclosing surface, said joint cover member also being provided on its longer limb with an internal rib which extends inwardly away from said longer limb adjacent the outermost end thereof and which fits into a respective said side slot of the sole piece section to fix the cover member in place, the length of said rib in transverse cross-section being greater than that of the shorter limb of the cover member, and, disposed above but adjacent to said rib, with a supplementary flange of which the outermost end also abuts against the side face of said exterior panel of the partition and thereby limits the extent to which said rib enters into said side slot of the sole piece section.

9. Means as claimed in claim 8, wherein the internal rib of the joint cover member is slightly inclined towards the shorter limb of said cover member thereby to facilitate fitting the joint cover member with close engagement between the outermost end of its shorter limb and the side face of said exterior panel of the partition.

10. Means as claimed in claim 8 or 9, wherein there is also provided at least one supplementary joint element which fits internally in the edge portion of the partition and wherein there are two pairs of said longitudinal upstanding flanges on the sole piece section forming two spaced apart slots which receive a flange or flanges of said supplementary joint element or elements to hold the latter in position.

11. Means as claimed in claim 10, wherein said supplementary joint element is a profiled plastics section in which opposite faces provide support surfaces for engaging, respectively, an interior side face of the panels of the partition and a face of a central core member within the interior of the partition, and a side edge portion lying in a plane parallel to, but set back from, one of said support surfaces provides a said flange which fits in one of the said two spaced apart slots of the sole piece section.

12. Means as claimed in claim 11, wherein the supplementary joint element has an opposite side edge portion which lies in a plane parallel to, but set back from, the other of said support surfaces and provides a second flange having means adapted to engage and locate an internal cover or spacing member for use with partitions having a double glazed construction.

13. Means as claimed in claim 10, wherein the supplementary joint element is a profiled plastics section comprising a base portion having opposite faces of which one face carries a pair of spaced said flanges which fit into the said two spaced apart slots of the sole piece section while the other face carries a second pair of upstanding flanges having means adapted to engage and locate an internal cover or spacing member for use with partitions having a double glazed construction.

* * * * *